United States Patent [19]

Garcia et al.

[11] Patent Number: 4,506,698

[45] Date of Patent: Mar. 26, 1985

[54] GARDEN HOSE STORAGE APPARATUS

[75] Inventors: George L. Garcia, Chicago; Richard D. Recker, Palatine; Thomas A. Tisbo, Barrington, all of Ill.

[73] Assignee: Suncast Corporation, Batavia, Ill.

[21] Appl. No.: 511,569

[22] Filed: Jul. 7, 1983

[51] Int. Cl.[3] ..... B65H 75/34

[52] U.S. Cl. ..... 137/355.26; 137/355.27; 137/580; 242/86; 403/375

[58] Field of Search ..... 137/355.16, 355.17, 137/355.18, 355.19, 355.2, 355.21, 355.22, 355.23, 355.24, 355.25, 355.26, 355.27, 355.28, 580; 403/353, 375; 242/86

[56] References Cited

U.S. PATENT DOCUMENTS

| | | | |
|---|---|---|---|
| 238,153 | 2/1881 | Piper | 137/580 |
| 1,901,660 | 3/1933 | Lund | 137/580 |
| 2,089,547 | 8/1937 | Folliot | 137/355.19 |
| 2,095,653 | 10/1937 | Tepel | 403/353 |
| 3,050,078 | 8/1962 | Hooper | 137/355.19 |
| 4,033,552 | 7/1977 | Kuzarov | 403/353 |
| 4,131,381 | 12/1978 | Alberts | 403/375 |

*Primary Examiner*—A. Michael Chambers
*Assistant Examiner*—Sheri Novack
*Attorney, Agent, or Firm*—Anthony S. Zummer

[57] ABSTRACT

A garden hose storage apparatus is particularly adapted for mounting on a substantially vertical surface and includes a side mount. The side mount has a base adapted for attachment to a substantially vertical surface and a cantilever journal is formed integral with the base. An elongated pipe is fixed in the cantilever journal and extends outwardly from the journal. A hose reel is rotatably mounted on the journal and has its axis of rotation substantially coincidental with the longitudinal axis of the pipe. An out tube is releasably connected to the pipe and has a connector adapted for connecting the out tube to a garden hose. A lock releasably connects the reel to the longitudinal pipe to retain the reel on the journal. Release of the lock allows the reel to be removed from the journal.

25 Claims, 10 Drawing Figures

GARDEN HOSE STORAGE APPARATUS

BACKGROUND OF THE INVENTION

Garden hoses present a problem in that they must be stored when they are not in use. A typical means of storing a garden hose is to wind the hose onto a reel. There are two general types of reels. One type of reel is a reel which is mounted on a frame which is supported on wheels so that the reel may be transported from place to place. The other type of reel is one which is secured to the side of a building, such as, a house. In colder climates, it is desirable to bring the garden hose indoors in the winter time. The portable hose reel is easy to bring indoors; however, the hose reel which is mounted on the side of a building oftentimes presents a problem, in that it is necessary to remove the hose reel from the building.

The typical hose reel which is mounted on the side of a building has a construction wherein the hose reel is generally rotatably mounted on a conduit for water flowing into the hose. U.S. Pat. No. 2,752,198, issued June 26, 1956, to H. M. Crow, entitled, "Hose Reels" shows a well known hose reel construction which is adapted for connection to an outlet faucet. The Crow hose reel construction allows the hose reel with a pipe to be removed from the faucet. Another typical hose reel construction is taught in U.S. Pat. No. 3,433,247, issued Mar. 18, 1969, to A. G. P. Haselden, entitled, "Hose Reels And Mountings Therefor". U.S. Pat. No. 4,251,038, issued Feb. 17, 1981, to Gename, entitled "Hose Reel" teaches an improved construction for a hand held reel. U.S. Pat. No. 2,935,966, issued May 10, 1960, to A. A. Anderson, entitled "Hose Reel" discloses a hose reel which may be quickly disconnected from its support for storing the hose.

It is recognized that the hose reels are generally kept outdoors in all types of weather so that the hose reel must be resistant to corrosion and must be operative under all circumstances. It is also necessary to provide a construction which is economical to manufacture and may be readily installed.

SUMMARY OF THE INVENTION

The instant garden hose storage apparatus is particularly adapted for mounting on a substantially vertical surface, such as, a wall of a building. The present apparatus includes a side mount having a base adapted to be secured to a substantially vertical surface, and a hollow cantilever journal formed integral with the base and extending outwardly therefrom. An elongated pipe is fixed in the cantilever journal and extends outwardly therefrom. A hose reel is rotatably mounted on the cantilever journal and has its axis of rotation substantially coincidental with the longitudinal axis of the elongated pipe. An out tube is connected to the pipe. The out tube has a connector for connecting the out tube to a garden hose. A lock releasably connects the reel to the pipe to retain the reel on the cantilever journal. Release of the lock allows the reel to be removed from the journal, and the out tube removed from the pipe.

DESCRIPTION OF THE PREFERRED EMBODIMENT

Figure 1:
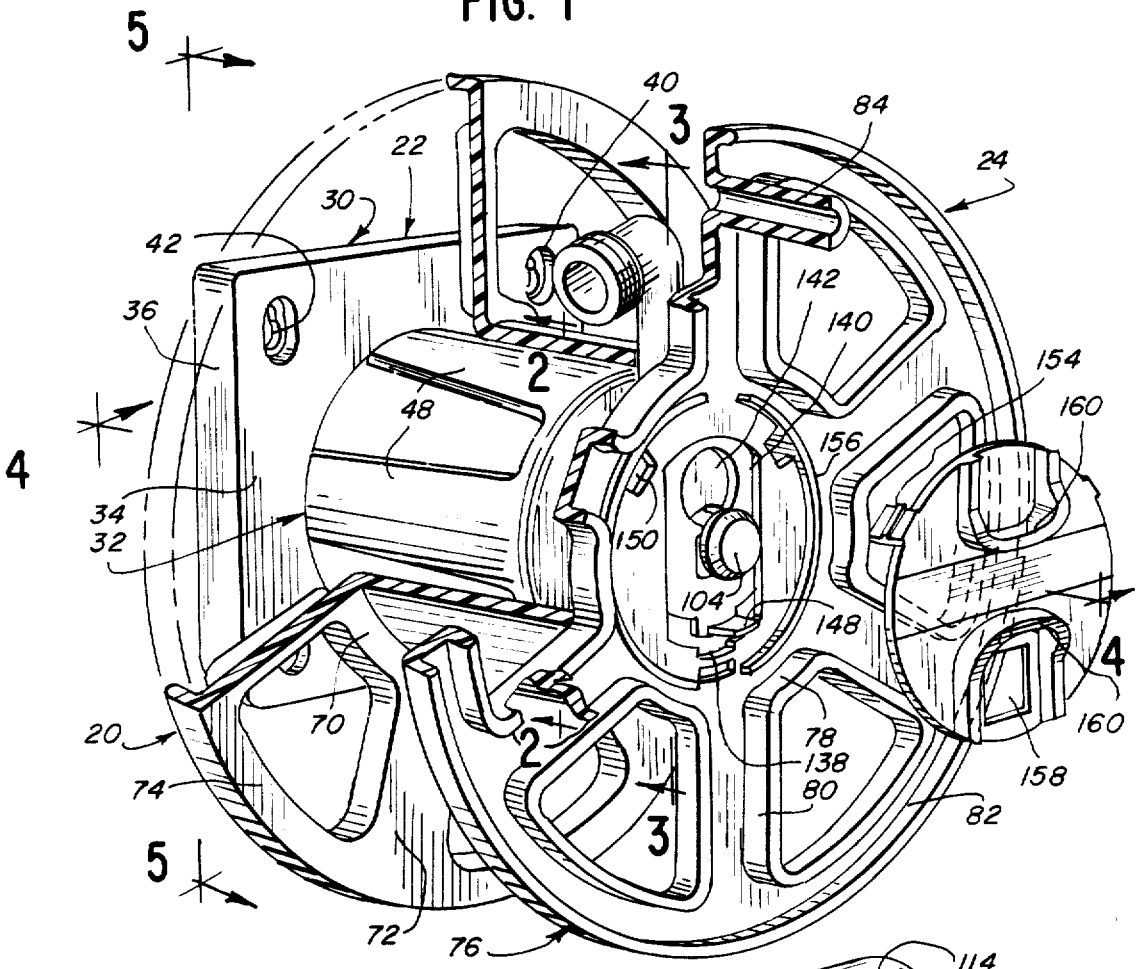
FIG. 1 is a perspective broken-away view with a cover exploded of a hose storage apparatus embodying the herein disclosed invention.
Figure 2:
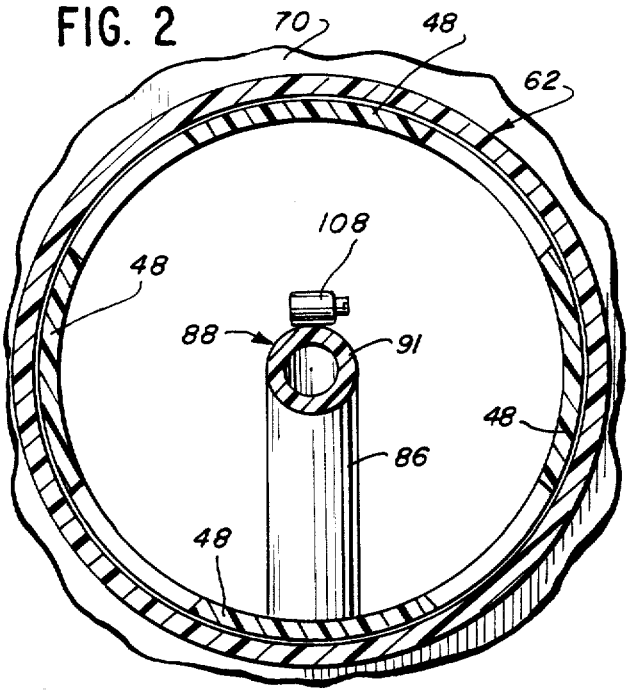
FIG. 2 is an enlarged fragmentary cross sectional view taken on line 2—2 of FIG. 1.
Figure 4:
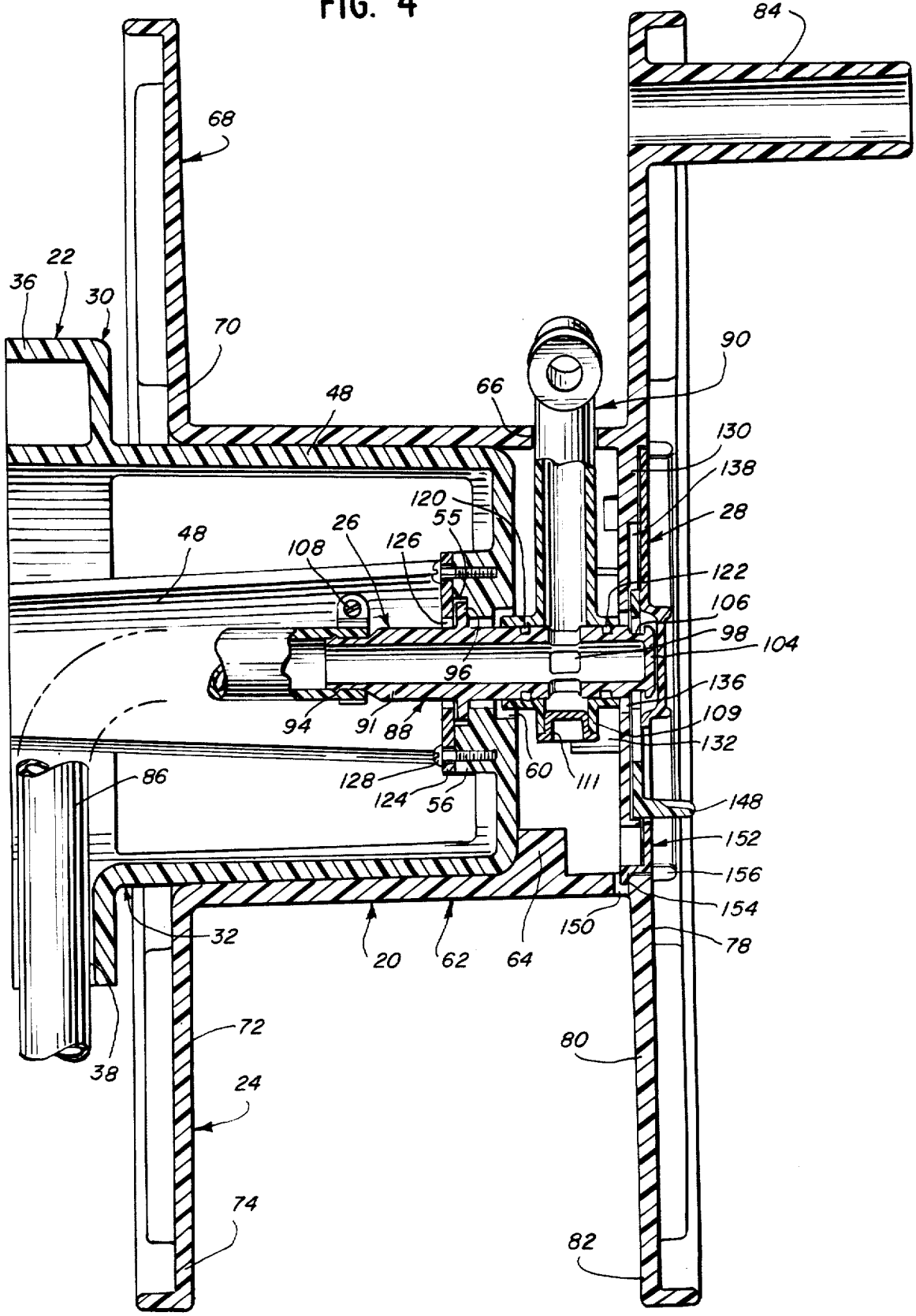
FIG. 4 is a cross sectional view taken on line 4—4 of FIG. 1.
Figure 5:
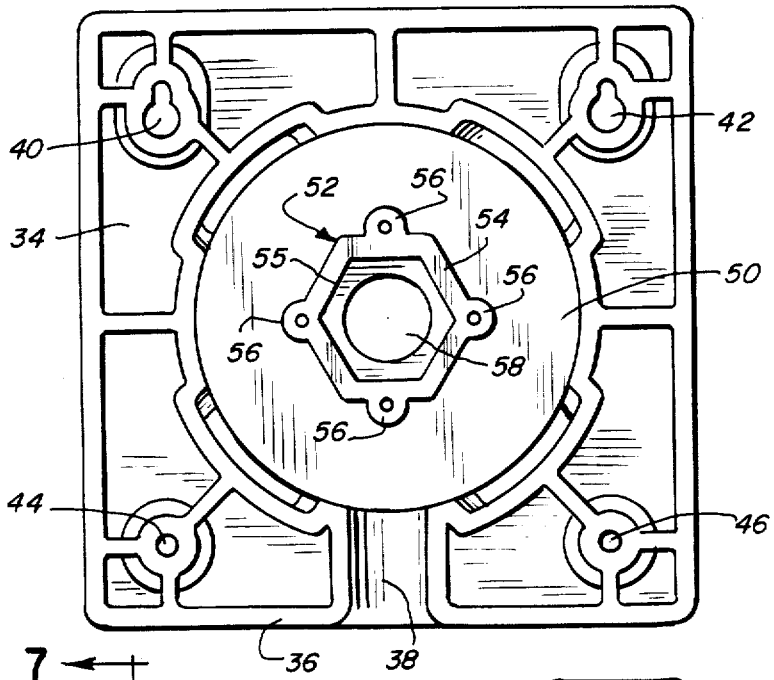
FIG. 5 is an elevational view of a base of the instant hose storage apparatus.
Figure 6:
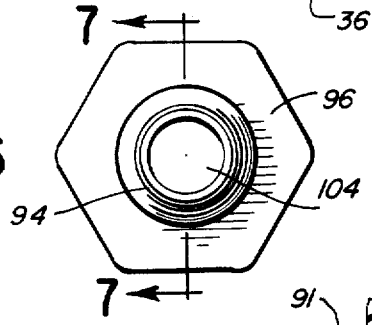
FIG. 6 is an end view of an elongated pipe which is part of the hose storage apparatus.
Figure 8:
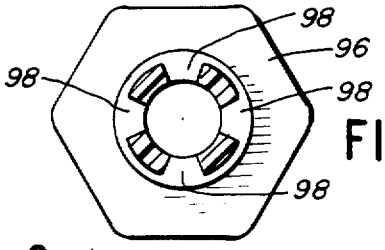
FIG. 8 is a cross sectional view taken on line 8—8 of FIG. 7.
Figure 7:
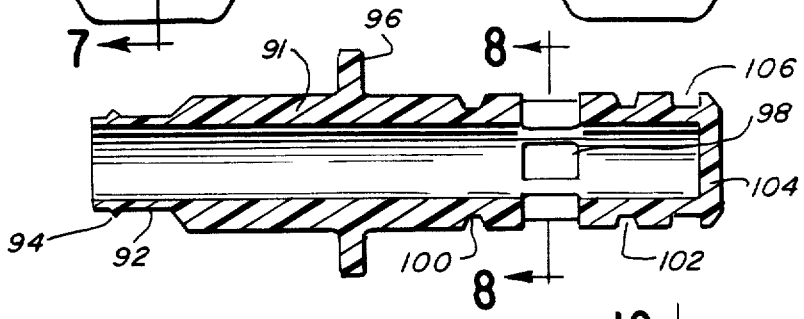
FIG. 7 is a cross sectional view taken on line 7—7 of FIG. 6.
Figure 10:
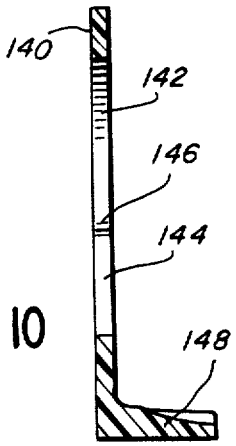
FIG. 10 is a cross sectional view taken on line 10—10 of FIG. 9.
Figure 9:
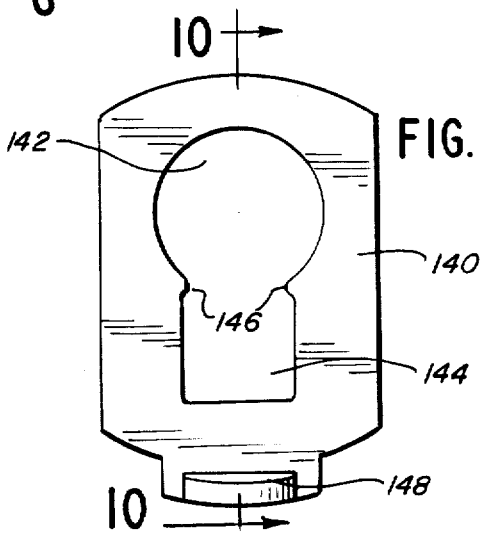
FIG. 9 is a side elevational view of a lock plate which is engagable with a portion of the elongated pipe.

Referring now to the drawings and especially to FIGS. 1 and 4, a garden hose support apparatus embodying the herein disclosed invention is shown therein and is generally indicated by numeral 20. The garden hose storage apparatus generally includes; a side mount 22, a hose reel 24 rotatably mounted on the side mount, a liquid conduit 26 mounted in the side mount and reel, and a lock 28 releasably securing the hose reel to the side mount.

Side mount 22 is a unitary molded plastic part made of polyethylene, though any other suitable plastic material may be used. The side mount generally includes a base 30 with a cantilever journal 32 formed integral with the base. Base 30 includes a substantially flat outer wall 34 having an outwardly extending peripheral edge 36. A hose recess 38 is formed in the base and extends through a portion of peripheral edge 36. A pair of slotted mounting apertures 40 and 42 is formed in the upper portion of wall 34, and a pair of circular mounting apertures 44 and 46 is formed in the lower portion of wall 34.

Journal 32 is tapered with its larger portion adjacent to the base. The journal includes four identical tapered arms 48. Each of the arms has its smaller portion adjacent to the base. An end plate 50 is formed integral with all of the arms.

A pipe flange receptacle 52 is formed integral with end plate 50. The pipe flange receptacle includes an outer peripheral wall 54 which defines a flange receiver 55 which is in the shape of a regular hexagon. Four regularly spaced mounting bosses 56 are spaced around the outer periphery of wall 54. A conduit aperture 58 is formed in the end plate in the center of the pipe flange receptacle. A receiver recess 60 is formed in the end plate concentric with the center of aperture 58.

Hose reel 24 is a molded unitary plastic part made of polyethylene plastic material, although any other suitable conventional moldable plastic material may be used instead. Hose reel 24 includes a hub 62, which has an interior taper which matches the exterior taper of journal 32 so that the journal mates with the interior of the hub. The hub has a plurality of internal journal bosses 64 which engage end plate 50 of the journal to position the hose reel on the journal. The hub includes an outlet tube aperture 66 adjacent to the outer end of the hub.

An inner flange 68 is formed integral with the end of hub 62 adjacent to base 30. The inner flange includes an inner ring 70 which has its inner portion formed integral with the hub. A plurality of arms 72 is formed integral with the inner ring. The arms 72 extend radially outward from inner ring 70. An outer ring 74 is formed integral with the ends of arms 72 forming a continuous outer peripheral edge.

An outer flange 76 is formed integral with the other end of hub 62. Flange 76 includes a flange ring 78 formed integral with hub 62. A plurality of radial arms 80 is formed integral with flange ring 78. An outer flange ring 82 is formed integral with the outer end of arms 80. A handle 84 is formed integral with a portion of outer flange ring 82 and one of the arms 80. The handle is substantially perpendicular to the remainder of the outer flange.

Liquid conduit 26 includes a conventional hose 86 which has a conventional female hose coupling on one end, which is not shown, and the other end is connected to an elongated pipe 88. The elongated pipe is rotatably connected to an out tube 90 which is positioned in aperture 66 of the hub. The elongated pipe is made of thermo plastic material such as, acetal resin, and specifically Delrin 507, manufactured by E. I. DuPont-De-Nemours And Company, of Wilmington, Del., however any other suitable plastic material may be used. The elongated pipe is straight and is symmetrical about a longitudinal axis. The pipe generally consists of a main tubular pipe body 91. A hose relief 92 is formed on one end of the pipe. A holding ridge 94 is formed on the relief for engagement with the interior of hose 86. A mounting flange 96 is formed integral with the body and extends radially outward therefrom. Flange 96 has a non-circular hexagonal outer periphery which mates with the flange receiver of the pipe flange receptacle in end plate 50. Four radial outlet apertures 98 are formed in the tube body. An O-ring groove 100 is formed on one side of the apertures adjacent to flange 96, and a second O-ring groove 102 is formed on the other side of apertures 98. A plug 104 is formed in the end of the pipe body to close off that end of the pipe. A lock groove 106 is formed in the pipe body adjacent to the end having plug 104. Connector hose 86 is mounted on hose relief 92 with ridge 94 engaging the interior of the hose. A conventional hose clamp 108 is mounted on the end of the connector hose to secure the connector hose to the elongated pipe.

Figure 3:
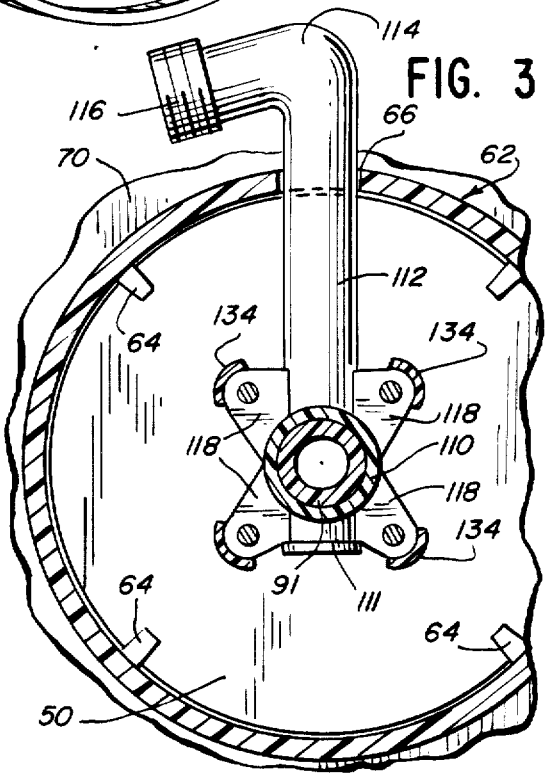
FIG. 3 is an enlarged fragmentary cross sectional view taken on line 3—3 of FIG. 1.

Out tube 90 is a molded unitary part made of a weatherable grade ABS, although other suitable materials may be used. The out tube includes a cylindrical receiver 110 which rotatably engages the outer periphery of pipe body 91 at outlet apertures 98. The receiver includes a drain 109, with a plug 111 fixed thereon. A radial tube 112 is formed integral with receiver 110 and communicates with the interior of the receiver so that the radial tube is in communication with outlet apertures 98. The radial tube extends through aperture 66 in hub 62. A connector tube 114 is formed integral with the radial tube and is in communication with the radial tube. A conventional male connector 116 is formed integral with the free end of connector tube 114. Out tube 90 includes four mounting ears 118 which are formed integral with receiver 110 and two of the mounting ears are formed integral with the radial tube, as may be best seen in FIG. 3.

An O-ring 120 is positioned in O-ring groove 100 and an O-ring 122 is positioned in O-ring groove 102. The O-rings 120 and 122 sealing engage the interior of the receiver to form seals between the elongated tube and the receiver on opposite sides of outlet apertures 98. A lock cap 124 having an aperture 126 is secured to mounting bosses 56 by conventional fasteners 128 to hold the pipe in the receptacle. It may be appreciated that the non-circular outer periphery of the pipe flange prevents rotation of the pipe and the lock cap prevents longitudinal removal of the pipe. Flange 96 has its outer periphery smaller than the interior of the receptacle so that the pipe may turn slightly. The thickness of the flange is less than the distance from the lock cap to the bottom of the receptacle to allow the pipe to move slightly axially. Aperture 126 of the lock cap is greater than the diameter of the pipe. The combination of the size of the flange and the diameter of the pipe relative to the size of the receptacle and the aperture in the cap allows the pipe to adjust its position relative to the mount, thereby accommodating wear of the parts or manufacturing inaccuracies.

Lock 28 includes a holding plate 130 which is formed integral with the outer flange of reel 24. The holding plate includes a plurality of pipe mounts 132 with positioning ears 134 formed integral therewith. Each of the mounting ears 118 is positioned in contact with the positioning ears and secured in position by conventional fasteners, thereby securing the out tube to the reel. Holding plate 130 includes a tube aperture 136 which rotatably receives one end of the elongated pipe. A lock plate recess 138 is formed in the holding plate to receive slideably a lock plate 140. Lock plate 140 includes an enlarged free opening 142 which communicates with a lock slot 144. A pair of dogs 146 extend inwardly toward each other between the free opening and the lock slot. An operating tab 148 is formed integral with the lock plate. The lock plate is positionable in the lock groove 106 to connect rotatably the lock plate with the pipe.

Holding plate 130 includes three lock apertures 150 along its outer periphery. A cover 152 includes three locking fingers 154 which are positionable in apertures 150 to lock the cover in position over the lock plate. A cover ring 156 aids in positioning the cover. The cover includes a tab aperture 158 formed therein to receive tab 148 of the lock plate. The cover includes a pair of lips 160 to facilitate the insertion and removal of the cover.

It may be appreciated that when the lock plate is in a position wherein the free opening 142 is concentric with the elongated pipe, the lock plate is not positioned in the lock groove 106 so that reel 24 may be moved axially along its longitudinal axis to remove the reel from the journal. In order to mount the reel on the journal, it is necessary to position the reel on the journal and to position the end of the elongated pipe through the free opening of lock plate 140. The lock plate is moved by grasping tab 148 to push the dogs 146 past the bottom of the groove 106 so that lock slot 144 receives the elongated pipe in lock groove 106. The dogs 146 prevent the lock plate from moving to an unlock position due to gravity. Thus, the reel is locked to the pipe, and the journal bosses 64 prevent the reel from being moved too far onto the journal, thereby assuring a proper location of the lock plate relative to the lock groove on the elongated pipe.

The base is secured to a substantially vertical wall by first hanging the base on fasteners positioned in apertures 40 and 42. The base is secured to position by fasteners through apertures 44 and 46 to hold the base in position. The connector hose passes through the hose recess 38 and is connected to a conventional water outlet having a male outlet connector. The connector hose is secured to the elongated pipe by clamp 108 so that water may flow from the connector hose into the elongated pipe and out through apertures 98 into the out tube. The water flows out of the out tube into a hose connected to connector 116. The longitudinal axis of the elongated pipe is concentric with the axis of the journal and the axis of the hub so that as the hub rotates on the journal, the out tube is free to rotate simultaneously on the elongated pipe. The reel may be quickly and easily removed from the journal simply by moving the lock plate so that the free opening is aligned with the pipe and the reel may be readily removed. In view of the fact that the seal between the pipe and the receiver of the out tube is formed by O-rings 120 and 122, the receiver may be quickly and easily removed from the pipe. The reassembly of the receiver to the pipe is also easily accomplished. In view of the fact that the instant hose reel storage apparatus is made of plastic parts, there is little likelihood of corrosion of the materials to have an adverse effect on the parts so that there is a high degree of durability. It is also to be noted that the hub of the reel rotates on a large journal so that there is little wear between the parts.

Although a specific embodiment has been disclosed in the foregoing specification and shown in the accompanying drawings, it is readily apparent that those skilled in the art may make various modifications and changes without departing from the spirit and scope of the present invention. It is to be expressly understood that the instant invention is limited only by the appended claims.

We claim:

1. A garden hose storage apparatus particularly adapted for mounting on a substantially vertical surface comprising; a side mount having a base adapted to be secured to a substantially vertical surface, and a hollow cantilever journal formed integral with the base and extending outwardly therefrom; an elongated pipe fixed in said cantilever journal and extending outwardly therefrom; a reel rotatably mounted on the journal, said reel having its axis of rotation substantially coincidental with the longitudinal axis of the elongated pipe; an out tube connected to the pipe, said out tube having a connector for connecting the out tube to a garden hose; and a lock releasably connecting the reel to the pipe to retain the reel on the journal; whereby release of the lock from the pipe allows the reel to be removed from the journal and the out tube released from its connection to the pipe.

2. A garden hose storage apparatus particularly adapted for mounting on a substantially vertical surface as defined in claim 1, wherein the out tube includes; an elongated receiver rotatably mounted on the pipe for receiving liquid from the pipe, a plurality of mounting ears formed integral with the receiver, a radial tube formed integral with the receiver and with the mounting ears, and a connector tube formed integral with the radial tube being connected to the connector, said mounting ears being secured to the reel.

3. A garden hose storage apparatus particularly adapted for mounting on a substantially vertical surface as defined in claim 1, wherein said elongated pipe includes; a hose relief on its end positioned interiorly of the journal for receiving a connector hose, an integral mounting flange extending radially outward, an outlet aperture positioned exteriorly of the journal in communication with the out tube, and a pair of O-ring grooves positioned on opposite sides of the outlet aperture; said journal having a pipe flange receptacle formed therein receiving the flange of the pipe, a lock cap secured to the journal holding the pipe flange in the pipe flange receptacle; and an O-ring mounted in each of the O-ring grooves to form a seal between the pipe and the out tube.

4. A garden hose storage apparatus particularly adapted for mounting on a substantially vertical surface as defined in claim 1, wherein the elongated pipe including; an outlet aperture exteriorly positioned in the journal, a pair of O-ring grooves formed on the exterior surface of the pipe with each O-ring groove being positioned on an opposite side of the outlet aperture, and a lock groove formed on the end of the pipe exteriorly of the journal; said out tube having an elongated receiver rotatably mounted on the pipe communicating with the outlet aperture; an O-ring mounted in each of the O-ring grooves forming a seal between the pipe and the receiver of the out tube; said reel rotatably receiving the pipe; and said lock including a lock plate mounted on the reel releasably engaging the lock groove of the pipe for releasably locking the reel to the pipe and retaining the reel on the journal.

5. A garden hose storage apparatus particularly adapted for mounting on a substantially vertical surface as defined in claim 1, wherein said journal has a taper extending from the base to the free end, said journal having the smaller portion at the free end; and said reel having a hub, said hub having an interior taper mateable with the taper of the journal, said hub having its interior in engagement with the journal, and said hub having its exterior adapted for receiving a garden hose.

6. A garden hose storage apparatus particularly adapted for mounting on a substantially vertical surface as defined in claim 1, wherein said elongated pipe has a lock groove formed on its end extending exteriorly of the journal, said reel having a holding plate on its outer side, said holding plate having a pipe aperture in its center rotatably receiving the end of the pipe exterior of the journal, and said lock including; a lock plate slideably mounted on the holding plate and being selectively positionable in the lock groove allowing rotation of the pipe in the holding plate, said lock plate in the lock groove preventing removal of the reel from the journal, said lock plate having an outwardly extending tab, and a cover mounted on the holding plate and having a tab aperture to receive the tab of the lock plate.

7. A garden hose storage apparatus particularly adapted for mounting on a substantially vertical surface as defined in claim 1, wherein said base includes a hose recess extending into a peripheral edge of the base, said elongated pipe having a hose relief on the end positioned interiorly of the journal, a flexible connector hose having one end receiving the hose relief of the pipe, and a clamp securing the connector hose to the hose relief.

8. A garden hose storage apparatus particularly adapted for mounting on a substantially vertical surface as defined in claim 1, wherein said elongated pipe includes; an integral mounting flange extending radially outward; said journal having a pipe flange receptacle formed therein receiving the flange of the pipe, a lock cap secured to the journal holding the pipe flange in the pipe flange receptacle, said pipe flange receptacle being larger than the flange to allow the flange to move sufficiently in the pipe flange receptacle to allow the pipe to accommodate its attitude relative to the journal and the reel to allow the reel to rotate freely on the jounral.

9. A garden hose storage apparatus particularly adapted for mounting on a substantially vertical surface as defined in claim 1, wherein said base is a molded plastic unitary member having the cantilever journal molded integral with the base, said reel being a molded plastic member, said reel having a hub rotatably mounted on the journal, and a plurality of journal bosses formed interiorly in the hub and engagable with the journal positioning the reel relative to the journal and positioning the reel relative to the end of the pipe extending exteriorly of the journal.

10. A garden hose storage apparatus particularly adapted for mounting on a substantially vertical surface as defined in claim 1, wherein the side mount is a molded plastic unitary member, said cantilever journal includes a plurality of tapered arms, each of said tapered arms being formed integral with the base at one end, an end plate formed integral with the other end of the tapered arms, said end plate having a pipe flange receptacle having a noncircular outer peripheral shape, said elongated pipe having an outwardly extending flange positioned in and mating with the pipe flange receptacle, and a lock cap secured to the end plate retaining the pipe flange in the pipe flange receptacle.

11. A garden hose storage apparatus particularly adapted for mounting on a substantially vertical surface as defined in claim 1, wherein said elongated pipe includes; a hose relief on its end positioned interiorly of the journal for receiving a connector hose, an integral mounting flange extending radially outward, an outlet aperture positioned exteriorly of the journal, and a pair of O-ring grooves positioned on opposite sides of the outlet aperture; said journal having a pipe flange receptacle formed therein receiving the flange of the pipe; a lock cap secured to the journal holding the flange in the pipe flange receptacle; the out tube including; an elongated receiver rotatably mounted on the pipe communicating with the outlet aperture, a plurality of mounting ears formed integral with the receiver, and a conduit tube formed integral with the receiver and with the mounting ears and being connected to the connector, said mounting ears being secured to the reel; and an O-ring mounted in each of the O-ring grooves to form a seal between the pipe and the elongated receiver of the out tube.

12. A garden hose storage apparatus particularly adapted for mounting on a substantially vertical surface as defined in claim 1, wherein the elongated pipe includes; an outlet aperture positioned exteriorly of the journal, a pair of O-ring grooves formed on the exterior surface of the pipe with each O-ring groove being positioned on an opposite side of the outlet aperture, and a lock groove formed on the end of the tube exteriorly of the journal, said out tube including; an elongated receiver rotatably mounted on the pipe in communication with the outlet aperture for receiving liquid from the pipe, and a conduit tube formed integral with the receiver and being connected to the connector; an O-ring mounted in each of the O-ring grooves forming a seal between the receiver and the tube; said reel rotatably receiving the pipe; and said lock including a locking plate releasably mounted on the reel selectively positioning the lock groove of the pipe for releasably locking the reel to the pipe and retaining the reel on the journal.

13. A garden hose storage apparatus particularly adapted for mounting on a substantially vertical surface as defined in claim 1, wherein said journal has a taper extending from the base to the free end, said journal having its smaller portion at the free end; said reel having a hub, said hub having an interior taper mateable with the taper of the journal, sad hub having its interior in engagement with the journal, and said hub having its exterior adapted for receiving a garden hose, and said out tube including; an elongated receiver rotatably mounted on the pipe and receiving liquid from the pipe, a plurality of mounting ears formed integral with the receiver, a condit tube formed integral with the receiver and with the mounting ears being connected to the connector and having a portion extending through the hub, said mounting ears being secured to the reel.

14. A garden hose storage apparatus particularly adapted for mounting on a substantially vertical surface as defined in claim 1, wherein said elongated pipe has a lock groove formed on its free end extending exteriorly of the journal, said reel having a holding plate on its outer side, said holding plate having a pipe aperture in its center rotatably receiving the end of the pipe extending out of the journal, said lock including a lock plate slideably mounted on the holding plate and being selectively positionable in the lock groove allowing the rotation of the pipe in the holding plate, said lock plate positioned in the lock groove preventing retraction of the pipe through the holding plate, said lock plate having an outwardly extending tab, a cover mounted on the holding plate and having a tab aperture to receive the tab of the lock plate, said out tube including, an elongated receiver rotatably mounted on the pipe for receiving liquid from the pipe, and a conduit tube formed integral with the receiver.

15. A garden hose storage apparatus particularly adapted for mounting on a substantially vertical surface as defined in claim 1, wherein said base includes a hose recess extending into a peripheral edge of the base, said elongated pipe having a hose relief on the end positioned interiorly of the journal, a flexible connector hose having one end receiving the hose relief of the pipe, said connector hose having a portion positioned in the hose recess, a clamp securing the connector hose to the hose relief, said out tube including an elongated receiver rotatably mounted on the pipe for receiving liquid from the pipe, and a conduit tube formed integral with the receiver.

16. A garden hose storage apparatus particularly adapted for mounting on a substantially vertical surface as defined in claim 1, wherein said base is a molded plastic unitary member having the cantilever journal molded integral with the base, said reel being a molded plastic unitary member, said reel having a hub rotatably mounted on the journal, said reel having a plurality of journal bosses formed interiorly in the hub and engageable with the journal positioning the reel relative to the journal and positioning the reel relative to the end of the pipe extending exteriorly of the journal; and said out tube including; an elongated receiver rotatably mounted on the pipe for receiving liquid from the pipe, a conduit tube formed integral with the receiver and being connected to the connector, and a plurality of mounting ears formed integral with the receiver and with the conduit tube, said mounting ears being secured to the reel.

17. A garden hose storage apparatus particularly adapted for mounting on a substantially vertical surface as defined in claim 1, wherein the side mount is a molded plastic unitary member, said cantilever journal includes a plurality of tapered arms, each of said tapered arms having one end formed integral with the base, an end plate formed integral with the other end of the tapered arms, said end plate having a pipe flange receptacle having a noncircular outer peripheral shape formed therein, said elongated pipe having an outwardly extending flange positioned in and mating with the pipe flange receptacle, a lock cap secured to the end plate retaining the pipe flange in the pipe flange receptacle; and said out tube including, an elongated receiver rotatably mounted on the pipe for receiving liquid from the pipe, a conduit tube formed integral with the receiver and being connected to the connector, and a plurality of mounting ears formed integral with the receiver and with the conduit tube, said mounting ears being secured to the reel.

18. A garden hose storage apparatus particularly adapted for mounting on a substantially vertical surface as defined in claim 1, wherein said elongated pipe includes; a hose relief on one end positioned interiorly of the journal for receiving a connector hose, an integral mounting flange extending radially outward, an outlet aperture positioned exteriorly of the journal in communication with the out tube, a lock groove formed on the end of the pipe exteriorly of the journal, and a pair of O-ring grooves positioned on opposite sides of the outlet aperture; said journal having a pipe flange receptacle formed therein receiving the flange of the pipe; a lock cap secured to the journal holding the flange in the pipe flange aperture; said out tube having an elongated receiver rotatably mounted on the pipe communicating with the outlet aperture; an O-ring mounted in each of the O-ring grooves forming a seal between the pipe and the receiver of the out tube; said reel rotatably receiving the pipe; and said lock including a lock plate mounted on the reel releasably engaging the lock groove of the pipe for releasably locking the reel to the pipe and retaining the reel in the journal.

19. A garden hose storage apparatus particularly adapted for mounting on a substantially vertical surface as defined in claim 1, wherein said journal has a taper extending from the base to the free end, said journal having the smaller portion of the taper at the free end, said reel having a hub, said hub having an interior taper mateable with the taper of the journal, said hub having its interior in engagement with the journal, said hub having its exterior adapted for receiving a garden hose, said elongated pipe has a lock groove formed on its end extending exteriorly of the journal, said reel has a holding plate on its outer side, said holding plate having a pipe aperture in its center rotatably receiving the end of the pipe exterior of the journal, said lock including a lock plate slideably mounted on the holding plate for being selectively positionable in the lock groove allowing rotation of the pipe in the holding plate, said lock plate positioned in the lock groove preventing retraction of the pipe through the holding plate, said lock plate having an outwardly extending tab, and a cover mounted on the holding plate and having a tab aperture to receive the tab of the lock plate.

20. A garden hose storage apparatus particularly adapted for mounting on a substantially vertical surface as defined in claim 1, wherein said base is a molded plastic unitary member having the journal molded integral with the base, said base including a hose recess extending into a peripheral edge of the base, said elongated pipe having a hose relief on the end positioned interiorly of the journal, a flexible connector hose having one end receiving the hose relief of the pipe, a clamp securing the connector hose to the hose relief, said reel being a molded plastic member, said reel having a hub rotatably mounted on the journal, and a plurality of journal bosses formed integral with and interiorly in the hub and engageable with the journal positioning the reel relative to the journal and positioning the reel relative to the end of the pipe extending exteriorly of the journal.

21. A garden hose storage apparatus particularly adapted for mounting on a substantially vertical surface as defined in claim 1, wherein the side mount is a molded plastic unitary member, said cantilever journal includes a plurality of tapered arms, each of said tapered arms having one end formed integral with the base, an end plate formed integral with the other end of the tapered arms, said end plate having a pipe flange receptacle having a noncircular outer peripheral shape, said elongated pipe having an outwardly extending pipe flange positioned in and mating with the pipe flange receptacle, a lock cap secured to the end plate retaining the pipe flange in the pipe flange receptacle, said reel being a molded plastic member, said reel having a hub rotatably mounted on the journal, and a plurality of journal bosses formed integral with the hub and engagable with the journal positioning the reel relative to the journal and positioning the reel relative to the end of the pipe extending exteriorly of the journal.

22. A garden hose storage apparatus particularly adapted for mounting on a substantially vertical surface as defined in claim 1, wherein the side mount is a molded plastic unitary member, said cantilever journal includes a plurality of tapered arms, each of said tapered arms having one end formed integral with the base, an end plate formed integral with the other end of the tapered arms, said reel being a molded plastic unitary member, said reel having a hub rotatably mounted on the journal, and a plurality of journal bosses formed interiorly in the hub and engagable with the journal positioning the reel relative to the journal and positioning the reel relative to the end of the pipe extending outwardly of the journal.

23. A garden hose storage apparatus particularly adapted for mounting on a substantially vertical surface as defined in claim 1, wherein said elongated pipe includes a hose relief on its end positioned interiorly of the journal for receiving a connector hose, a flexible connector hose having one end receiving the hose relief of the pipe, a clamp securing the connector hose to the hose relief, said elongated pipe having an integral outwardly extending pipe flange, said journal having a pipe flange receptacle formed therein receiving the pipe flange, a lock cap secured to the journal holding the pipe flange in the pipe flange receptacle, said elongated pipe having an outlet aperture positioned exteriorly of the journal, a pair of O-ring grooves positioned on opposite sides of the outlet aperture, said out tube including an elongated receiver rotatably mounted on the pipe and in communication with the outlet aperture to receive liquid through the outlet aperture, an O-ring mounted in each of the O-ring grooves to form a seal between the pipe and the elongated receiver of the out tube, said pipe having a lock groove formed on the end of the pipe exteriorly of the journal, and said lock including a lock plate mounted on the reel releasably engaging the lock groove of the plate for releasably locking the reel to the pipe for retaining the reel on the journal.

24. A garden hose storage apparatus particularly adapted for mounting on a substantially vertical surface as defined in claim 1, wherein said base is a molded plastic unitary member having the cantilever journal molded integral with the base, said cantilever journal includes a plurality of tapered arms, each of said tapered arms having one end formed integral with the base, an end plate formed integral with the other end of the tapered arms, said reel being a molded plastic unitary member, said reel having a hub rotatably mounted on the journal, and a plurality of journal bosses formed interiorly in the hub and engagable with the journal positioning the reel relative to the journal and positioning the reel relative to the end of the pipe extending exteriorly of the journal.

25. A garden hose storage apparatus particularly adapted for mounting on a substantially vertical surface as defined in claim 1, wherein said base is a molded plastic unitary member having the cantilever journal molded integral with the base, said cantilever journal includes a plurality of tapered arms, each of said tapered arms having one end formed integral with the base, an end plate formed integral with the other end of the tapered arms, said end plate having a noncircular pipe flange receptacle, said elongated pipe having a hose relief on its end positioned interiorly of the journal for receiving a connector pipe, an integral pipe flange extending radially outward from the pipe and being mateably positioned in the pipe flange receptacle, an outlet aperture in the pipe positioned exteriorly of the journal, a pair of O-ring grooves on the exterior surface of the pipe positioned on opposite sides of the outlet aperture, a lock cap secured to the journal holding the pipe flange in the pipe flange receptacle, said out tube including an elongated receiver rotatably mounted on the pipe for receiving liquid from the outlet aperture, a radial tube formed integral with the receiver and communicating with the receiver, a connector tube formed integral with the radial tube connected to the connector, a plurality of mounting ears formed integral with the receiver and the radial tube, said mounting ears being secured to the reel, an O-ring mounted in each of the O-ring grooves to form a seal between the pipe and the receiver, said pipe having a lock groove formed on its end extending exteriorly of the journal, said reel having a holding plate on its outer side rotatably receiving the pipe, said lock including a lock plate slideably mounted on the holding plate and being selectively positionable in the lock groove, said lock plate positioned in the lock groove preventing retraction of the pipe through the holding plate, said lock plate having an outwardly extending tab, and a cover mounted on the holding plate and having a tab aperture to receive the tab of the lock plate.

* * * * *

UNITED STATES PATENT AND TRADEMARK OFFICE

CERTIFICATE OF CORRECTION

PATENT NO. : 4,506,698

DATED : March 26, 1985

INVENTOR(S) : Garcia et al.

It is certified that error appears in the above-identified patent and that said Letters Patent are hereby corrected as shown below:

Claim 8, Column 7, Line 3, cancel "jounral" and substitute therefor, --journal--.

Claim 13, Column 8, Line 7, cancel "sad" and substitute therefor, --said--.

Claim 13, Column 8, Line 13, cancel "condit" and substitute therefor, --conduit--.

Signed and Sealed this

*Twenty-third* Day of *July 1985*

[SEAL]

*Attest:*

DONALD J. QUIGG

*Attesting Officer*

*Acting Commissioner of Patents and Trademarks*